US006790106B2

(12) United States Patent
Ito et al.

(10) Patent No.: US 6,790,106 B2
(45) Date of Patent: Sep. 14, 2004

(54) MALE TERMINAL FITTING AND METHOD OF FORMING IT

(75) Inventors: Hikaru Ito, Yokkaichi (JP); Yoshio Okura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/631,603

(22) Filed: Jul. 31, 2003

(65) Prior Publication Data

US 2004/0023566 A1 Feb. 5, 2004

(30) Foreign Application Priority Data

Aug. 7, 2002 (JP) ..... 2002-229954

(51) Int. Cl.[7] ..... H01R 13/04; H01R 11/11

(52) U.S. Cl. ..... 439/884; 439/877; 439/866

(58) Field of Search ..... 439/884, 845, 439/858, 852, 874, 877, 866

(56) References Cited

U.S. PATENT DOCUMENTS 4,764,133 A * 8/1988 Kaneko ..... 439/889
4,992,064 A * 2/1991 Steinhardt et al. ..... 439/845
5,073,132 A 12/1991 Nottrott ..... 439/884
5,281,178 A * 1/1994 Biscorner ..... 439/845
5,591,054 A * 1/1997 Okada et al. ..... 439/884
5,649,842 A * 7/1997 Ohsumi ..... 439/858
5,681,192 A 10/1997 Kobayashi et al. ..... 439/884
6,077,131 A * 6/2000 Fukuda et al. ..... 439/884
6,375,521 B2 * 4/2002 Tachi et al. ..... 439/884

* cited by examiner

*Primary Examiner*—P. Austin Bradley
*Assistant Examiner*—Briggitte R. Hammond
(74) *Attorney, Agent, or Firm*—Anthony J. Casella; Gerald E. Hespos

(57) ABSTRACT

A tab (20) has first and second plates (21, 22). A bulge (23) of the first plate (21) is spaced from the second plate (22). Supports (25) project from the bulge (23) and contact with the second plate (22). Thus, a sufficient strength is secured for the tab (20). The supports (25) are in contact with the second plate (22) at positions displaced toward side edges from the free ends (28*a*). Thus, there is no danger that the supports (25) will thrust themselves between the free ends (28*a*) to separate the free ends (28*a*) when the first plate (21) is pressed, thereby preventing the tab (20) from being deformed.

8 Claims, 10 Drawing Sheets

MALE TERMINAL FITTING AND METHOD OF FORMING IT

BACKGROUND OF THE INVENTION

1. Field of the Invention

The invention relates to a male terminal fitting having a tab at its front end and to a method of forming it.

2. Description of the Related Art

A male terminal fitting having a tab at its front end is formed by bending a metallic plate of uniform thickness. It is desirable to thin the metallic plate to reduce the cost and weight. However, a necessary thickness is specified for the tab, and the specified thickness of the tab may be twice the thickness of the metallic plate.

U.S. Pat. No. 5,681,192 and FIG. 11 herein disclose prior work by the assignee of the subject invention to accommodate such dimensional requirements. As shown in FIG. 11, a tab 100 of the male terminal fitting has a substantially flat plate 102 formed at the front side by folding left and right sides of a metallic plate in and opposing free ends 101*a* of folded portions 101 to each other. A plate 103 at the rear side has a bulge 104 and a supporting projection 105 of the bulge 104 contacts the front plate 102.

With this construction, the tab 100 may be twice as thick as the metallic plate by taking a double-layered structure by the front and rear plates 102, 103 and forming the rear plate 103 with the bulge 104. The strength of the tab 100 may be reduced since the bulge 104 defines a space between the front and rear plates 102, 103. However, a sufficient strength is secured for the tab 100 by bringing the supporting projection 105 at the rear plate 103 into contact with the front plate 102.

The tab 100 is made transversely symmetrical for a sufficient strength and since a terminal main body (not shown) extending back from the base end of the tab 100 is transversely symmetrical. Thus, the two folded portions 101 at the front side, the bulge 104 and the supporting projection 105 are formed transversely symmetrically, and the supporting projection 105 is at a position where the free ends 101*a* of the folded portions 101 are opposed to each other.

The supporting projection 105 is at a position where the free ends 101*a* of the folded portions 101 are opposed to each other. Thus, a pressing force on the rear plate 103 may thrust the supporting projection 105 between the free ends 101*a* to deform the front plate 102 in a manner to separate the free ends 101*a*.

The present invention was developed in view of the above problem and an object thereof is to provide a male terminal fitting which can prevent a deformation of a tab.

SUMMARY OF THE INVENTION

The invention relates to a male terminal fitting formed with a double-layered tab by bending, folding and/or embossing a conductive plate. The tab comprises a first plate and a substantially flat second plate formed by substantially opposed free ends of two folded portions folded inward substantially along widthwise direction at the left and right edges of the first plate. The first plate is formed with at least one bulge spaced apart from the second plate and supports projecting from the bulge toward the second plate and held substantially in contact with the two folded portions at positions displaced toward side edges from the free ends of the two folded portions.

The opposed free ends of the two folded portions may be held in contact with each other or may have a clearance therebetween.

The tab could be weaker due to the space between the two plates. However, the supports projecting from the bulge are held in contact with the second plate. Therefore, a sufficient strength is secured for the tab.

The supports contact the second plate at positions displaced toward the side edges from the free ends. Accordingly, the supports cannot thrust move between the free ends even if a pressing force acts on the first plate in a direction toward the second plate. Thus, the tab is not likely to deform.

The first plate preferably is formed with a substantially flat portion to be held substantially in surface contact with the two folded portions in a continuous area including a position where the free ends of the two folded portions are substantially opposed to each other. Accordingly, a pressing force on the first plate is dispersed in the flat portion and acts on the second plate, and a concentration of stress on the second plate can be avoided.

The left and right edges of the flat portion preferably are continuous with the supports. Thus, the supports and the flat portion form a substantially U-shaped cross section. Accordingly, the shape of the first plate portion is simpler than a case where the flat portion and the supports are separate.

The rear end of the tab may be continuous with a transversely symmetrical terminal main body, and/or the free ends of the two folded portions are opposed substantially at a widthwise center of the tab and the supports are substantially equidistant from the opposed position of the free ends. Thus, there is no danger that only one of the left and right sides will be deformed during formation of a portion coupling the tab and the terminal main body. Accordingly, the concentration of a stress can be avoided.

Two bulges preferably are provided in the first plate spaced along the widthwise direction and have an intermediate plate therebetween.

The intermediate plate preferably is spaced from the leading ends of the folded portions.

The invention also relates to a method of forming a male terminal fitting with a double-layered tab. The method comprises providing a conductive plate. The method continues by bending, folding and/or embossing the conductive plate to form a tab with a first plate and a substantially flat second plate such that opposing free ends of two folded portions are folded inward along a widthwise direction at the lateral edges of the first plate. The method then includes forming the first plate with at least one bulge spaced apart from the second plate and supports projecting from the bulge toward the second plate and held substantially in contact with the two folded portions at positions displaced toward side edges from the free ends of the two folded portions.

The step of forming the first plate may comprise forming a substantially flat portion to be held in surface contact with the two folded portions in a continuous area including a position where the free ends of the two folded portions are opposed to each other.

Preferably, the rear end of the tab is formed to be continuous with a transversely symmetrical terminal main body.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
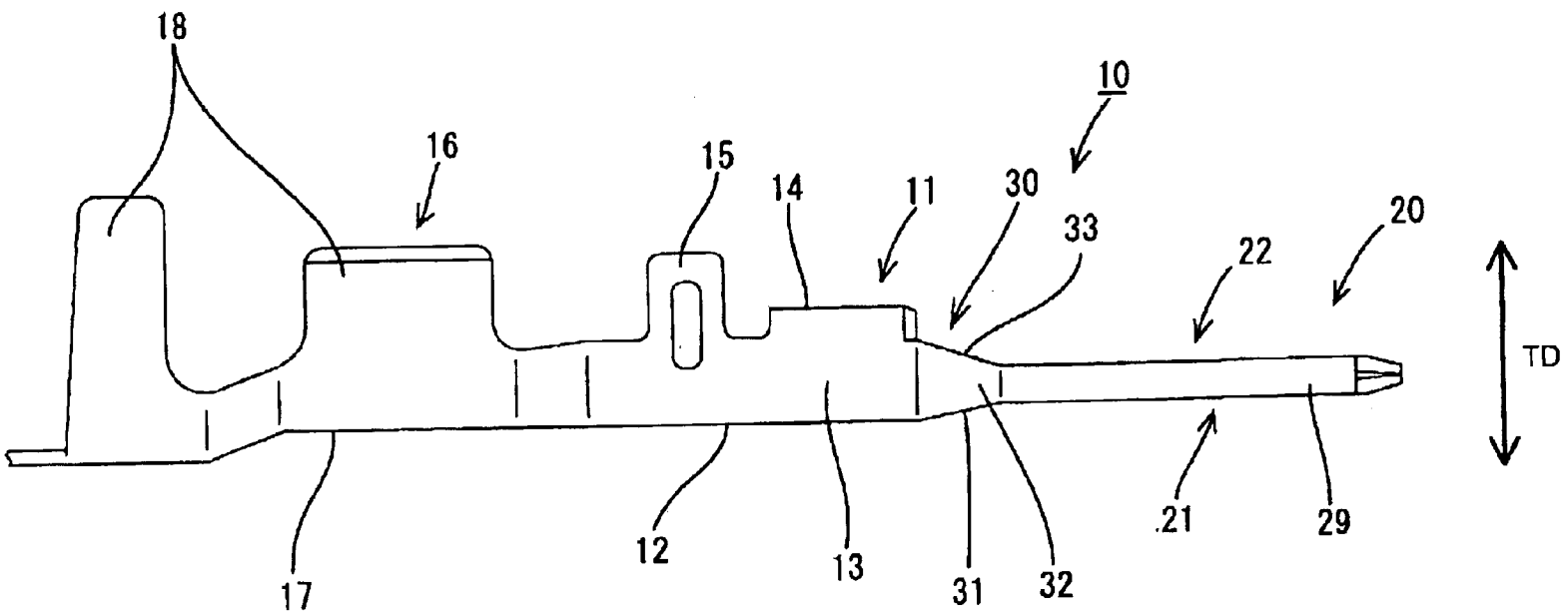
FIG. 1 is a side view of a male terminal fitting according to a first embodiment of the invention.
Figure 2:
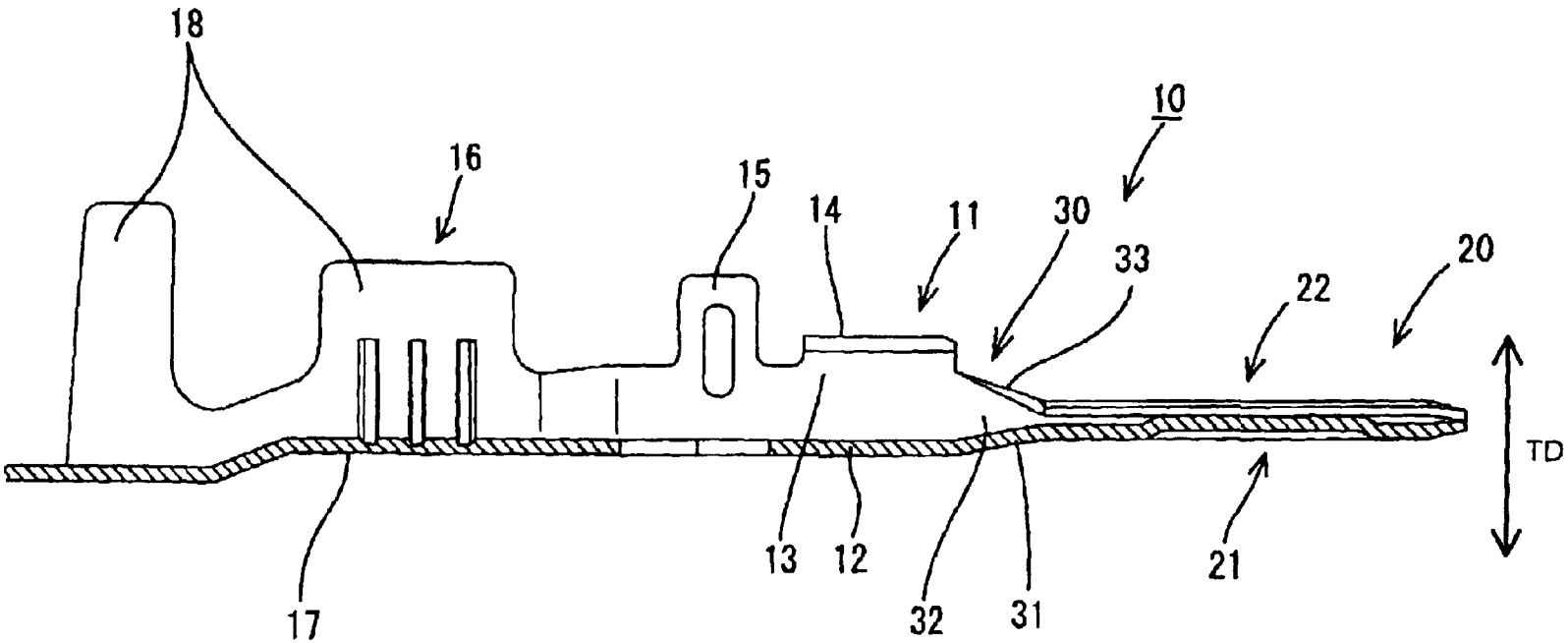
FIG. 2 is a longitudinal section of the male terminal fitting.
Figure 3:
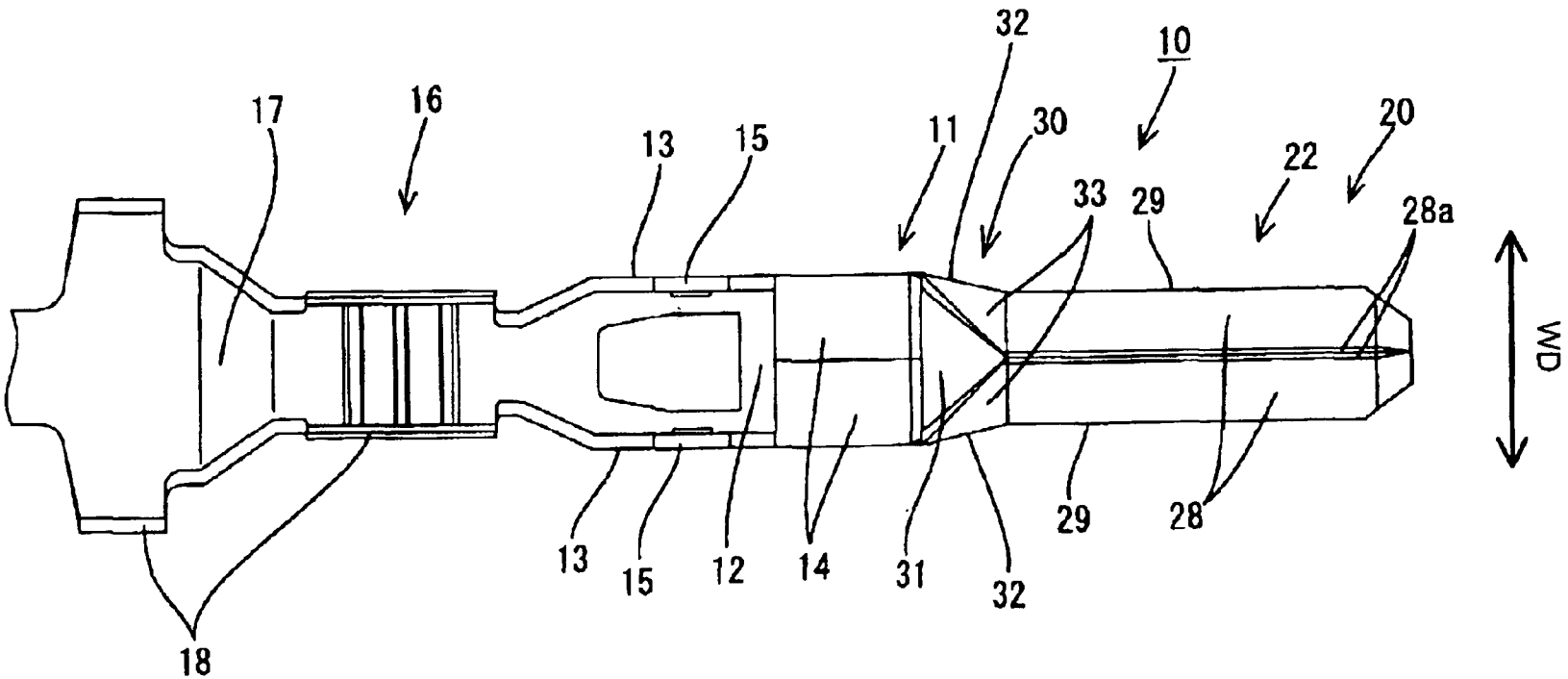
FIG. 3 is a plan view of the male terminal fitting.
Figure 4:
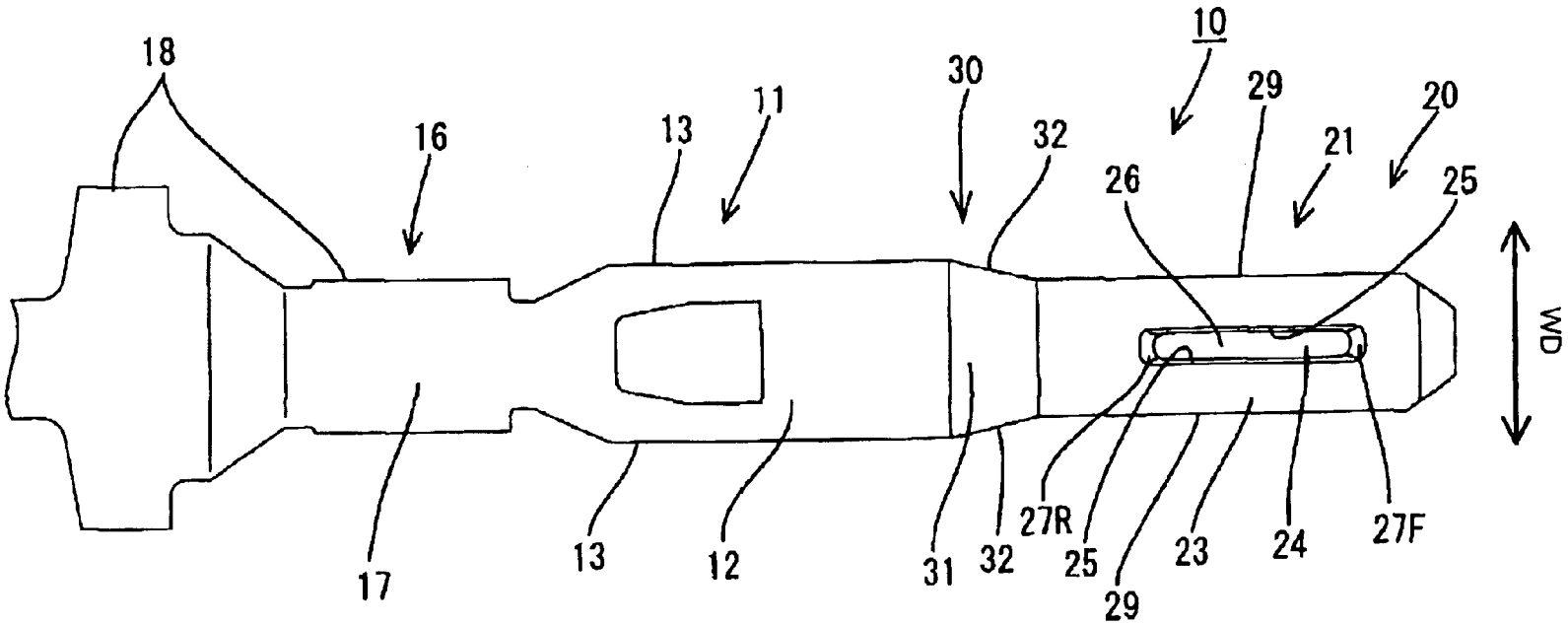
FIG. 4 is a bottom view of the male terminal fitting.
Figure 5:
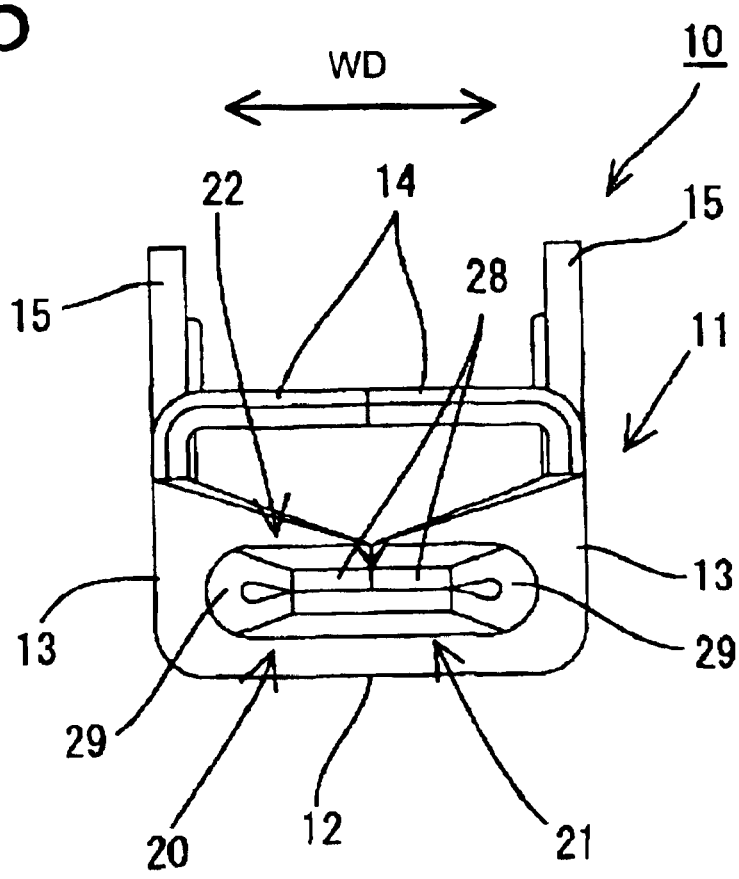
FIG. 5 is a front view of the male terminal fitting.
Figure 6:
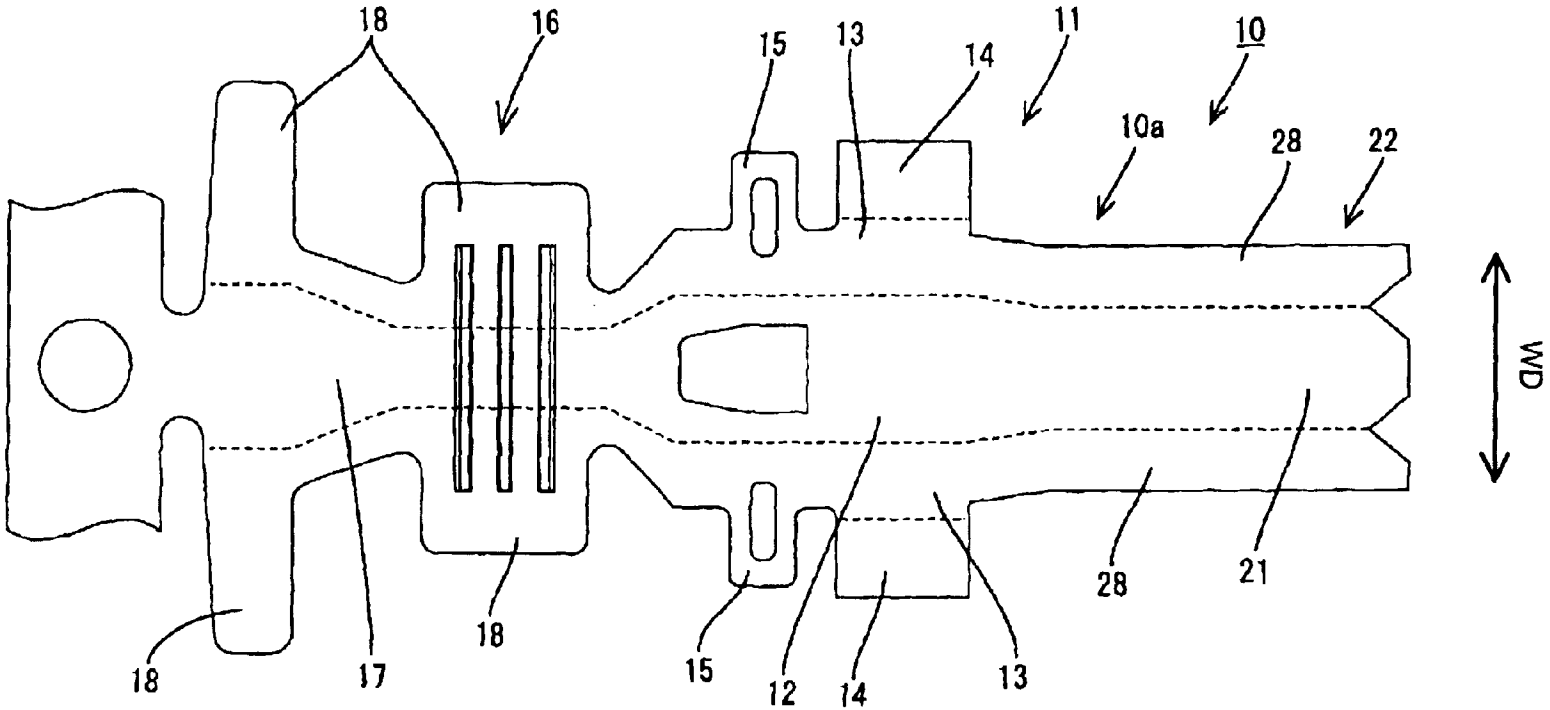
FIG. 6 is a development of the male terminal fitting.
Figure 7:
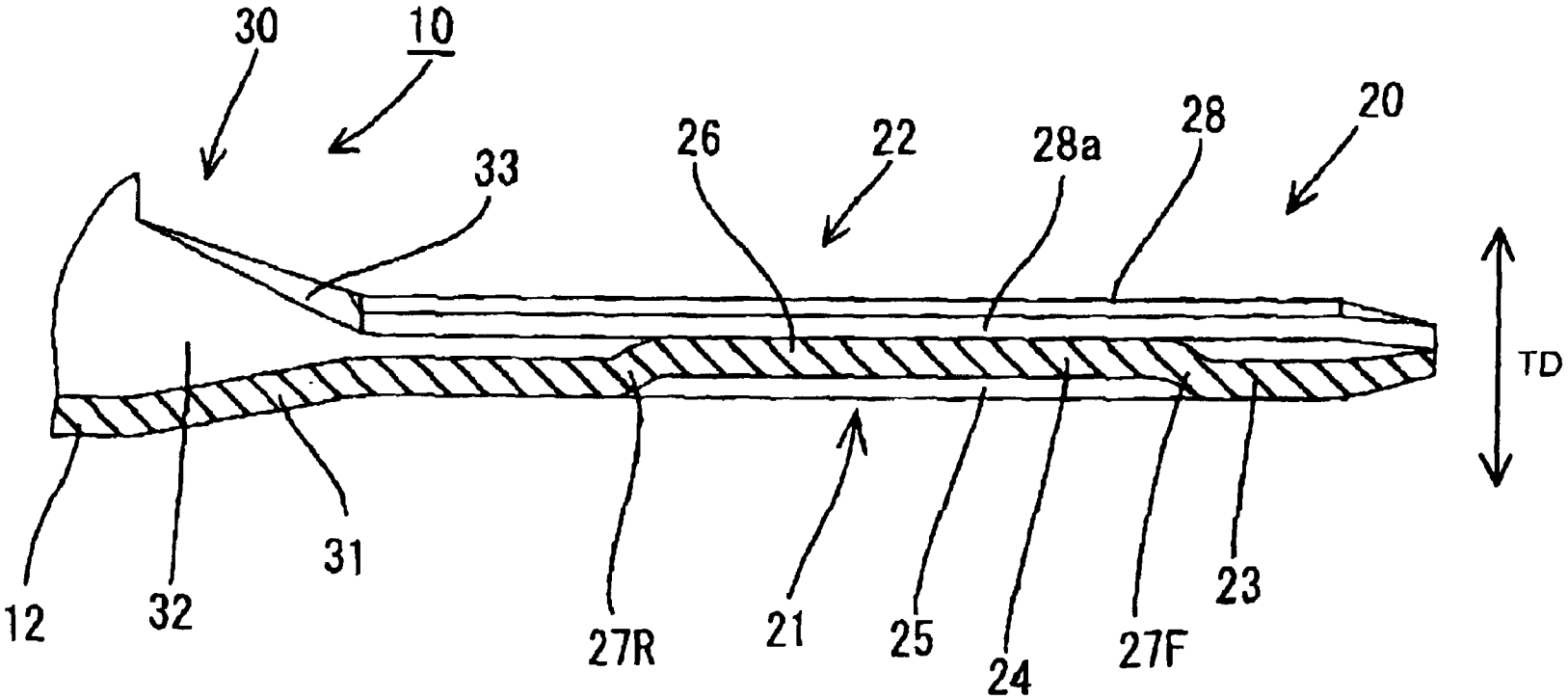
FIG. 7 is a partial enlarged longitudinal section of a tab.

A male terminal fitting 10 according to a first embodiment is identified by the numeral 10 in FIGS. 1 to 9. The male terminal fitting 10 is formed by bending, folding and/or embossing a conductive metallic plate 10*a* (see FIG. 6) stamped or cut out into a specified shape. The metallic plate 10*a* has a substantially uniform thickness and is narrow and long along forward and backward directions. A narrow tab 20 projects forward from a main body 11 and a wire crimping portion 16 projects back from the main body 11.

Substantially flat side walls 13 stand up substantially at right angles from the left and right edges of a substantially flat bottom plate 12, and substantially flat upper plates 14 extend in from front end portions of the upper edges of both side walls 13 substantially in parallel with the bottom plate 12 while substantially opposing the extending ends thereof. Stabilizers 15 stand up at positions of the upper edges of both sidewalls 13 behind the upper plates 14 while being held substantially flush with the sidewalls 13. The terminal main body 11 has a transversely symmetrical shape.

The wire-crimping portion 16 is an open barrel in which two pairs of front and rear crimping pieces 18 stand up from the left and right edges of a bottom plate 17. The bottom plate 17 and the crimping pieces 18 of the wire-crimping portion 16 are substantially continuous with the bottom plate 12 and the sidewalls 13 of the terminal main body 11, respectively. Such a wire-crimping portion 16 is crimped, bent or folded into connection with an end of a wire (not shown). Alternatively or additionally a wire insulation displacement portion or a wire soldering or welding portion may be provided as a wire connection portion.

The tab 20 is narrow and long along forward and backward directions and preferably has a substantially constant width over the entire length. The tab 20 has a double-layered structure comprised of a first plate 21 located at the lower side and a second plate 22 arranged on the upper surface of the first plate 21 and has a substantially transversely symmetrical shape similar to the main body 11. It should be noted that a front-end of the tab 20 preferably is tapered.

The first plate 21 is made of a single plate, and a part thereof excluding a widthwise middle area narrow along forward and backward or longitudinal directions is formed into a bulge 23 spaced apart from the second plate 22. This bulge 23 is substantially continuous with the second plate 22 at its left and right edges. The bulge 23 is horizontal and substantially flat.

An embossed portion 24 projects up along the thickness direction TD and is formed substantially in the widthwise middle area of the first plate 21, which area is narrow along forward and backward directions. The left and right edges of the embossed portion 24 serve as supports 25, and a portion between these supports 25 serves as a substantially flat portion 26. The two supports 25 extend substantially straight along forward and backward directions, and project up toward the second plate 22 obliquely in from the bulge 23. The two supports 25 are at positions displaced leftward and rightward from the widthwise center by the substantially same distance and are substantially transversely symmetrical with each other. The flat portion 26 is substantially parallel with the bulge 23, and the left and right edges thereof are substantially continuous with the two supports 25. In other words, the flat portion 26 couples the two supports 25, and the two supports 25 and the flat portion 26 form a substantially U-shaped cross section in combination (FIG. 8).

A front wall 27F substantially continuous with the front ends of the two supports 25, the front end of the flat portion 26 and the bulge 23 is formed at the front ends of the supports 25 and/or the flat portion 26, whereas a rear wall 27R substantially continuous with the rear ends of the supports 25, the rear end of the flat portion 26 and/or the bulge 23 is formed at the rear ends of the supports 25 and the flat portion 26. Accordingly, the first plate portion 21 has no opening vertically penetrating it.

The second plate 22 is formed by a pair of left and right folded portions 28 extending in from the left and right edges of the bulge 23 of the first plate 21, and the folded portions 28 and the bulge 23 are coupled via substantially semicircular folded back portions 29 at their corresponding edges. The two folded portions 28 are substantially parallel to the bulge 23 and the flat portion 26, flat and narrow along forward and backward directions, and substantially transversely symmetrical with each other. The end faces of free ends 28*a* of the two folded portions 28 are opposed to each other and substantially in contact or in proximity at substantially a widthwise center position of the tab 20. Thus, the two folded portions 28 are substantially side by side and substantially flush with each other at the same height to form the substantially flat second plate portion 22.

Figure 8:
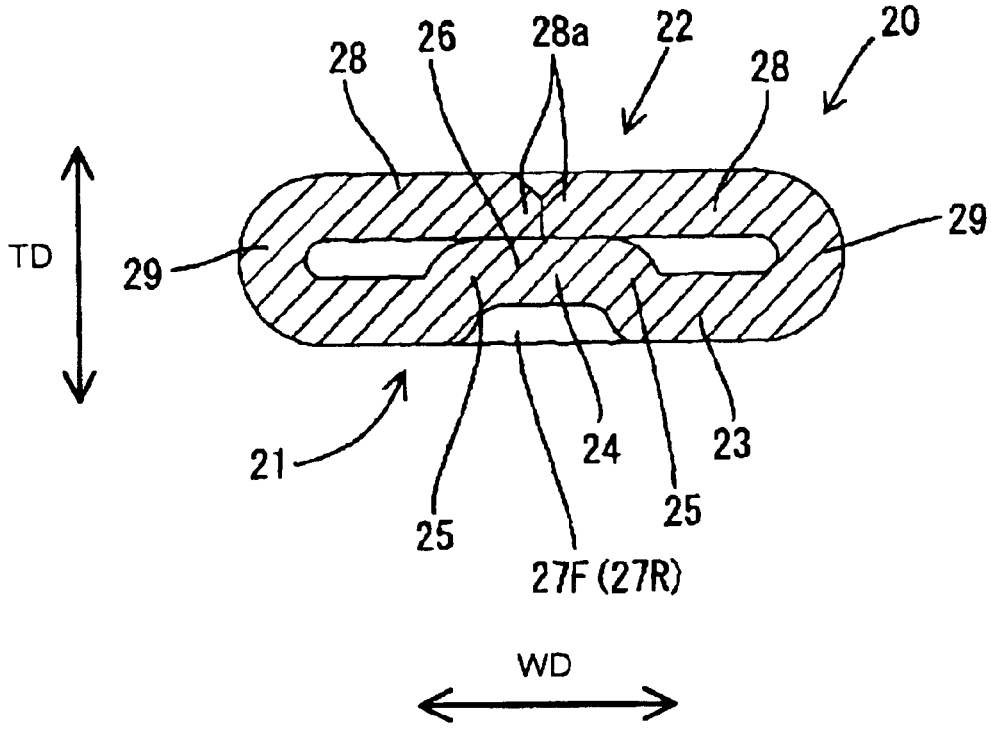
FIG. 8 is a partial enlarged lateral section of a tab.

The two left and right supports 25 of the first plate 21 are at least partly in contact with the lower surfaces of the corresponding folded portions 28 at positions displaced toward the side edges from the free ends 28 (FIG. 8). The contact positions of the two supports 25 are substantially equidistant from the position where the free ends 28*a* of the folded portions 28 are opposed, i.e. are transversely symmetrical. The flat portion 26 is substantially in surface contact with a continuous area including the opposed position of the free ends 28*a* on the lower surfaces of the two left and right folded portions 28, i.e. an area between the contact positions of the two supports 25. The contact area of the flat portion 26 and the two folds 28 is substantially transversely symmetrical.

The rear end of the tab 20 is coupled to the main body 11 via a coupling portion 30. The coupling portion 30 is in the form of a box tapered toward the front and comprised of a bottom plate 31 coupling the bottom wall 12 of the main body 11 and the first plate 21. Side walls 32 project from the left and right edges of the bottom plate 31 and couple the side walls 13 of the main body 11 and the substantially semicircular portions 29 of the tab 20. Upper plates 33 of substantially triangular or trapezoidal plan view extend in from the sidewalls 32, and are coupled to the folded portions 28 of the tab 20. The coupling portion 30 also is transversely symmetrically and is similar to the terminal main body 11 and the tab 20.

Figure 9:
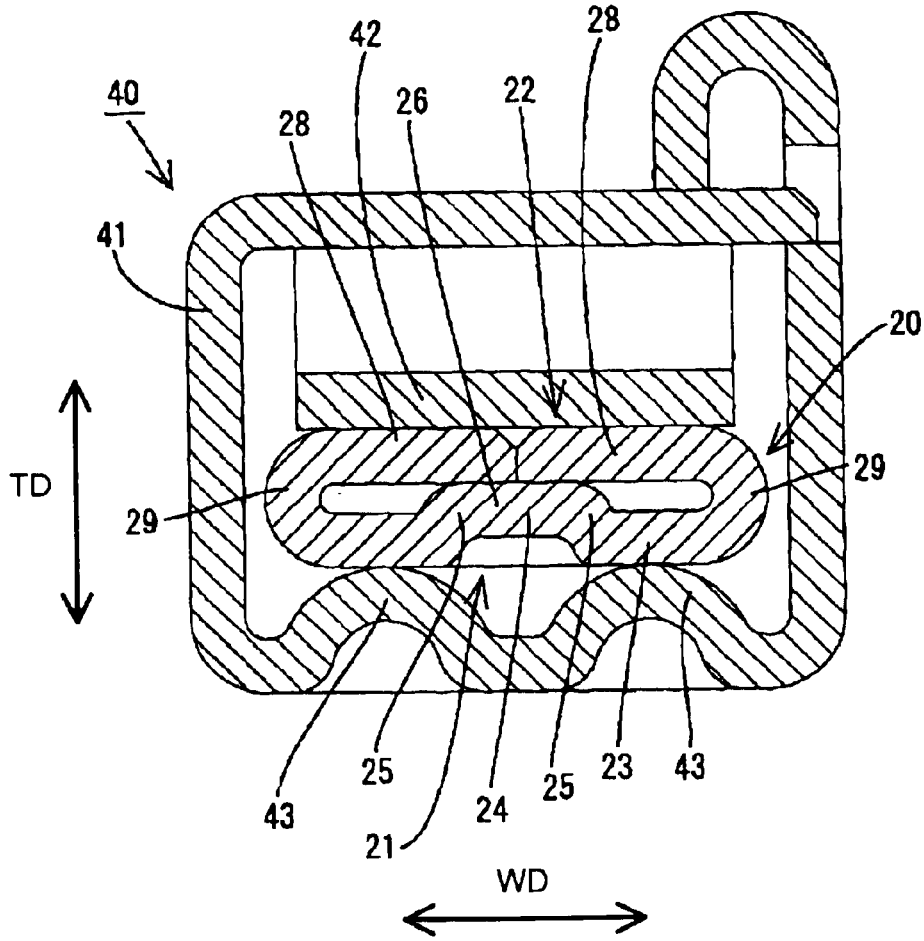
FIG. 9 is a lateral section showing a connected state of the tab and a female terminal fitting.

The male terminal fitting 10 can be connected with a female terminal fitting 40 via the tab 20. The female terminal fitting 40 includes a substantially rectangular tube 41 and a resilient contact piece 42 is provided inside the rectangular tube 41. The tab 20 is squeezed between left and right ribs 43 on the bottom wall of the rectangular tube 41 and the resilient contact piece 42 as shown in FIG. 9, and the tab 20 and the two ribs 43 are connected electrically with a specified contact pressure by the resilient force of the resilient contact piece 42. The two ribs 43 are held substantially in contact at two positions of the bulge 23 of the first plate 21 at the left and right sides of the embossed portion 24, and these contact positions are transversely symmetrical with respect to the widthwise center position of the tab 20.

The tab 20 of the male terminal fitting 10 of this embodiment has the double-layered structure comprised of the first and second plates 21, 22 and, at the same time, has a hollow structure by forming the first plate 21 with the bulge 23 spaced apart from the second plate 22. Thus, the thickness of the tab 20 can be set at a value larger than twice the thickness of the conductive plate 10*a* used to form the tab 20.

The strength of the tab 20 may be reduced due a space defined between the first and second plates 21, 22 by the bulge 23. However, a sufficient strength is secured for the tab 20 since the supports 25 projecting from the bulge 23 are held substantially in contact with the second plate 22.

The supports 25 are substantially in contact with the second plate 22 at positions displaced toward the side edges from the free ends 28*a* or spaced therefrom along a widthwise direction WD. Accordingly, a pressing force acting on the first plate 21 along the thickness direction TD and toward the second plate 22 is received at substantially middle positions of the folded portions 28 with respect to the widthwise direction. Thus, there is no danger that the supports will thrust themselves between the free ends to separate the free ends such as a case where a support is at a position where the free ends are opposed to each other, and there is no danger of deforming the tab 20.

The first plate 21 is formed with the flat portion 26 held substantially in surface contact with the two folded portions 28 in the continuous area including the position where the free ends 28*a* are opposed to each other. Thus, a pressing force on the first plate 21 is dispersed in the flat portion 26 and acts on the second plate 22. Accordingly, a concentration of a stress on the second plate 22 can be avoided.

The left and right edges of the flat portion 26 are continuous with the supports 25, and the supports 25 and the flat portion 26 form a U-shaped cross section. Accordingly, the shape of the first plate 21 is simplified as compared to a case where the flat portion 26 and the supports 25 are separated.

The tab 20 and the main body 11 are substantially transversely symmetrical. Thus, there is no danger that only one of the left and right sides of the coupling 30 is forcibly deformed while forming the coupling 30 to couple the tab 20 and the main body 11, and there is no concentration of a stress.

Figure 10:
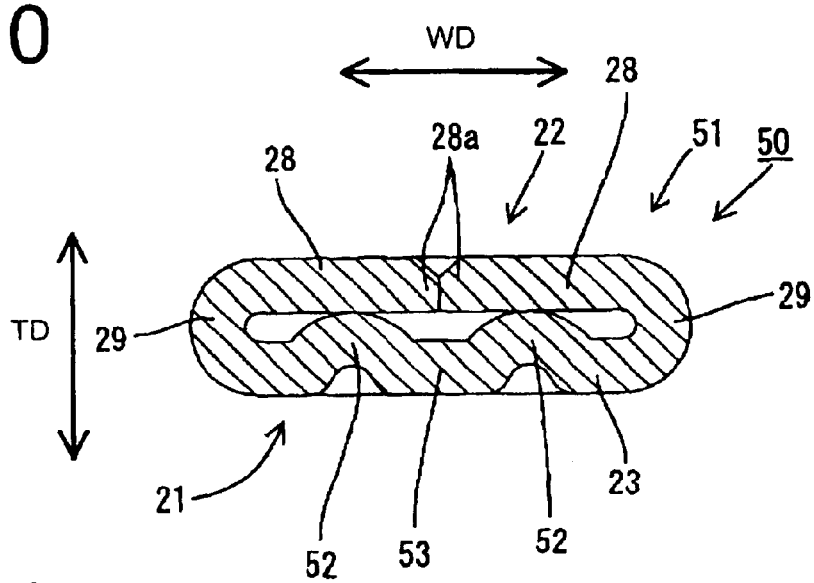
FIG. 10 is a lateral section of a tab according to a second embodiment.
Figure 11:
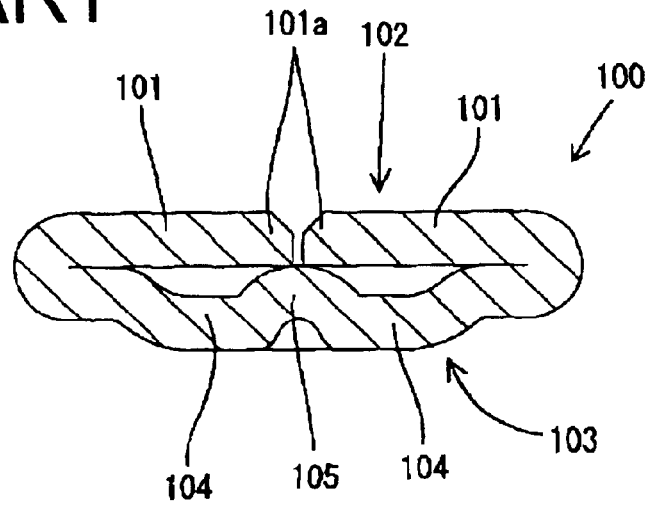
FIG. 11 PRIOR ART
FIG. 11 is a lateral section of a prior art tab.

A male terminal fitting according to a second embodiment is identified by the numeral 50 in FIG. 10. The terminal fitting 50 has a tab 51 constructed differently from the first embodiment. Specifically, unlike the first embodiment in which the flat portion 26 coupling the left and right supports 25 is formed, a first plate 21 is formed with no portion corresponding to the flat portion 26 and left and right supports 52 project substantially semicircularly from a bulge 23 toward a second plate 22 independently of each other and are held substantially in contact with folded portions 28 in the tab 51 of the second embodiment. Further, an area between the two supports 52 serves as an intermediate plate 53 that is substantially flat and/or substantially flush with (at the same height as) the bulge 23. The two supports 52 are formed into beads independent of each other. The supports 52 are narrow and straight along forward and backward directions and are formed by embossing from below along the thickness direction TD. Since the other construction is similar to or the same as in the first embodiment, no description is given on the structure, functions and effects thereof by identifying it by the same reference numerals.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The tab is transversely symmetrical in the foregoing embodiments. However, it may be transversely asymmetrical according to the present invention. In this case, only one of the first and second plates may be transversely asymmetrical.

A space is defined between the first and second plates at the left and right edges of the tab in the foregoing embodiments. However, the first and second plates may be held in close contact at the left and right edges of the tab according to the present invention.

The left and right edges of the flat portion are continuous with the supports in the first embodiment. However, the flat portion and the supports may not be substantially continuous according to the invention. In this case, the supports may be in line contact or in surface contact with the second plate.

The supports are in line contact with the second plate portion in the second embodiment. However, the supports may be substantially in surface contact according to the present invention.

What is claimed is:

1. A male terminal fitting formed with a double-layered tab wherein:

the tab comprises a first plate with opposite substantially parallel lateral folds and a substantially flat second plate formed by two folded panels unitary with the first plate at the respective lateral folds, the folded panels being folded inward substantially along a widthwise direction from the lateral folds of the first plate, the folded panels having substantially planar surfaces facing the first plate and free edges substantially opposed to each other; and the first plate being formed with at least two bulges spaced from the second plate and supports projecting from the bulges toward the second plate and held substantially in contact with planar surfaces of the two folded panels at positions displaced toward the parallel lateral folds of the first plate from the free ends of the two folded panels.

2. The male terminal fitting of claim 1, wherein a rear end of the tab is continuous with a transversely symmetrical main body.

3. The male terminal fitting of claim 1, wherein the free ends of the two folded panels are opposed substantially at a widthwise center of the tab and the supports are arranged at positions equidistant from the free ends.

4. The male terminal fitting of claim 1, wherein the first plate is formed with a substantially flat portion held substantially in surface contact with the two folded panels in a continuous area including a position where the free ends of the two folded panels are substantially opposed to each other.

5. The male terminal fitting of claim 4, wherein lateral edges of the flat portion are continuous with the supports.

6. The male terminal fitting of claim 1, wherein the supports include two supports spaced along the widthwise direction and wherein the at least two bulges comprise two lateral bulges disposed substantially adjacent the lateral folds of the first plate and an intermediate bulge arranged between the supports.

7. The male terminal fitting of claim 6, wherein the intermediate bulge is spaced from the free ends of the folded panels.

8. A method of forming a male terminal fitting with a double-layered tab, comprising the following steps:

providing a conductive plate material having first and second substantially parallel edges on at least a portion of the plate material;

forming a first plate substantially centrally between the edges, such that the first plate has at least first and second bulges spaced apart from one another and such that at least first and second supports are defined between and projecting from the bulges;

folding the conductive plate material along first and second fold lines extending substantially parallel to the edges, such that the first fold line is disposed between the first edge and the first bulge and such that the second fold line is between the second edge and the second bulge to define first and second folded panels supported respectively on the first and second supports of the first plate and so that the first and second edges of the plate material are substantially opposed to each other for defining a substantially flat second plate extending between the first and second fold lines.

* * * * *